United States Patent [19]

Berkhof

[11] Patent Number: 4,695,052

[45] Date of Patent: Sep. 22, 1987

[54] HOT WATER HEATING SYSTEM USING A HEAT CONSUMPTION METER

[75] Inventor: Hendrikus Berkhof, Emmen, Netherlands

[73] Assignee: Honeywell B.V., Amsterdam, Netherlands

[21] Appl. No.: 928,944

[22] Filed: Nov. 10, 1986

[30] Foreign Application Priority Data

Dec. 16, 1985 [DE] Fed. Rep. of Germany ..... 3544411

[51] Int. Cl.[4] ..... G05D 23/00

[52] U.S. Cl. ..... 237/8 R; 165/11.1; 236/94

[58] Field of Search ..... 165/22, 11.1; 236/94; 374/39–41; 237/8 R; 364/148

[56] References Cited

U.S. PATENT DOCUMENTS

| | | | |
|---|---|---|---|
| 2,329,813 | 9/1943 | Amsler | 374/39 |
| 4,009,825 | 3/1977 | Coon | 165/22 X |
| 4,412,647 | 11/1983 | Lampert | 165/11.1 X |
| 4,433,810 | 2/1984 | Gottlieb | 237/8 R |

*Primary Examiner*—William E. Wayner

*Attorney, Agent, or Firm*—Mitchell J. Halista; Albin Medved

[57] ABSTRACT

A hot water heating system powered by a gas burner uses the output signal of a heat consumption meter measuring the amount of heat flowing to heating radiators for controlling the heat capacity or heating power of the burner. A control signal dependent on the demand of heat is fed to a solenoid operator of a servopressure regulator and the required amount of air for achieving optimum combustion is supplied via an air control valve which receives its input signal from an oxygen or carbon dioxide sensor in a burner stack.

5 Claims, 1 Drawing Figure

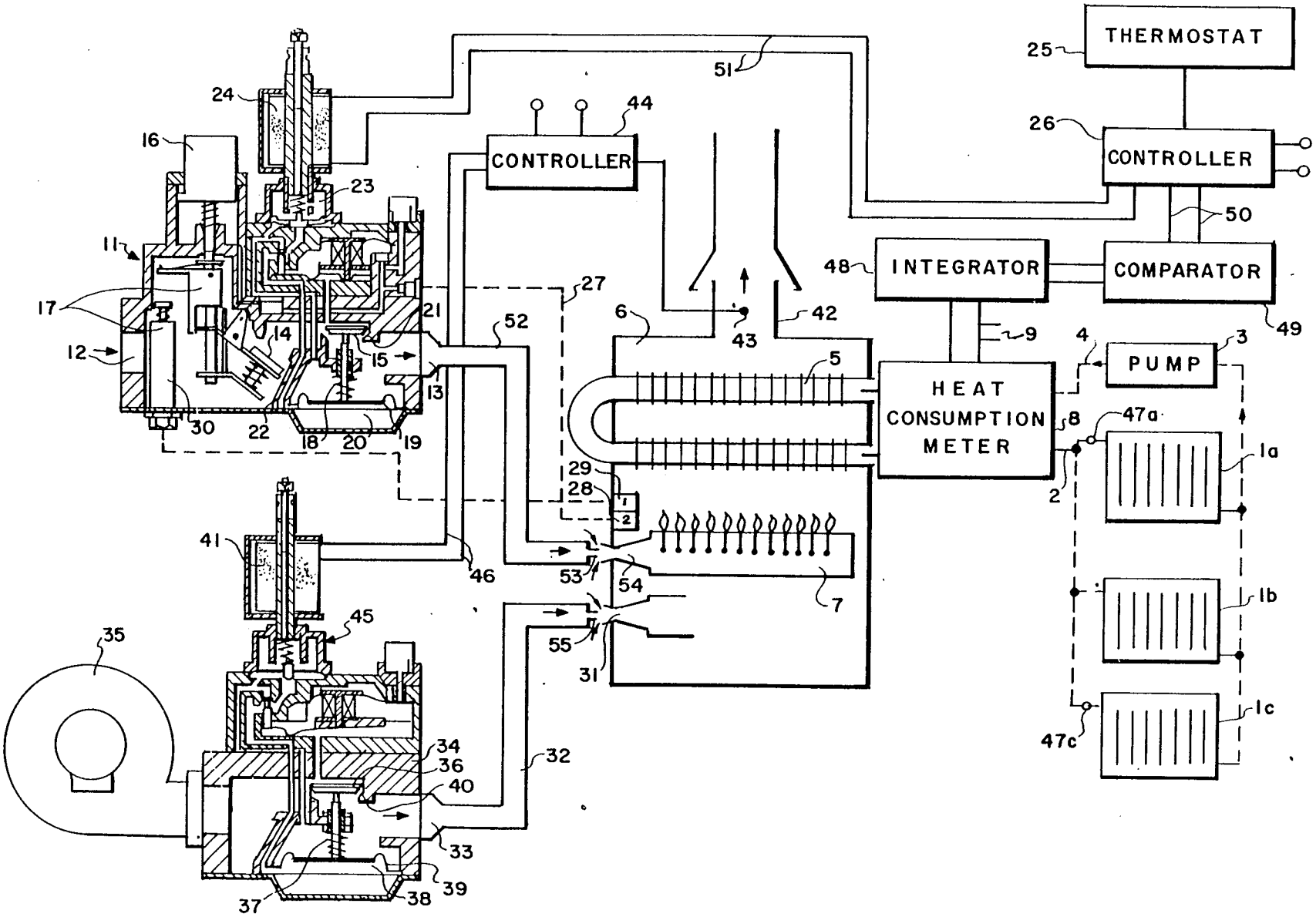
THERMOSTAT
CONTROLLER
COMPARATOR
PUMP
INTEGRATOR
HEAT CONSUMPTION METER
CONTROLLER

HOT WATER HEATING SYSTEM USING A HEAT CONSUMPTION METER

BACKGROUND OF THE INVENTION

1. Field of the Invention

The invention relates to a heating system. More specifically, the present invention is directed to a hot water heating system.

2. Description of the Prior Art

A heat consumption meter as described in European Pat. No. 24 778 is known for calculating an output signal which is proportional to the supplied amount of heat by measuring the flow of the heating fluid as well as by measuring the temperature of the heating fluid in the supply pipe to and in the return pipe from the heat exchangers to form the difference between these two temperatures. By integrating the supplied amount of heat per time unit, i.e., by integrating the heat power over a predetermined period of time, the total heat consumption is calculated and indicated. This heat consumption value then is used for determining and distributing heating costs. Furthermore, from European Pat. No. 62 856 a control device for a gas-fired boiler of a hot water heating system is known in which a burner is supplied via a gas control valve with an amount of gas corresponding to the measured demand of heat, and the amount of combustion air fed to the burner is continuously coordinated with the amount of gas. In order to generate a measuring value characterizing the demand of heat for said control device a temperature sensor is provided in the hot water supply pipe and in the hot water return pipe, respectively, and both temperature sensors are connected to the input of a master controller. If the temperature difference of the temperatures measured by the sensors deviates from a predetermined setpoint, the gas supply is accordingly either decreased or increased by means of a servopressure regulator.

SUMMARY OF THE INVENTION

It is the object of the invention to improve the temperature control of a hot water heating system, in particular to avoid excessive temperature changes, and to utilize the supplied fuel as effectively as possible.

It is a further object to facilitate the generation of a signal characterizing the instant demand of heat in a hot water heating system.

In accomplishing these and other objects, there has been provided, in accordance with the present invention, a hot water heating system including a heat consumption means for providing an electrical output signal proportional to the amount of heat being supplied to the heating system and a controller means which controls the heating power of a heat generator, the output signal being supplied as an input signal to the controller.

BRIEF DESCRIPTION OF THE DRAWING

A better understanding of the present invention may be had when the following detailed description is read in connection with the accompanying drawing in which the single FIGURE is a block diagram of a hot water heating system embodying the present invention.

DESCRIPTION OF THE PREFERRED EMBODIMENT

Referring to the single figure drawing in more detail, there is shown a hot water heating system embodying the present invention. Briefly, the present invention uses a heat consumption meter which is used for measuring the heat consumption and for simultaneously controlling the instant heating power of a heat generator, i.e., to control the burner capacity, in such a manner that the heat source is operated at all times with such heat producing power as is just sufficient to generate the required amount of heat. The burner, accordingly, does not generate excessive heat, and, therefore, the operation of the burner and the utilization of the fuel is optimized.

A plurality of heating radiators 1*a*, 1*b*, 1*c* are connected in parallel via a supply pipe 2 and a circulating pump 3 and via a return pipe 4 to the heat exchanger 5 of a boiler 6 which is heated by means of a burner 7. A heat consumption meter 8 is connected between the heat exchanger 5 and the supply and return pipes 2 and 4, respectively, with the heat consumption meter 8 continuously measuring the entire amount of heat as supplied to radiators 1*a*, 1*b*, 1*c*. The heat consumption meter 8 delivers on its output lines 9 an output signal corresponding to the heating power supplied.

A gas supply (not shown) to the burner 7 is controlled by means of a gas-controlled apparatus 11 comprising a safety valve 14 and a main gas valve 15 connected in series between inlet 12 and outlet 13. The safety valve 14 cooperates with a switch-on push button 16 and a safety latching system 17 as is known in the art. A closure member 15 of the main gas valve is biased in a closing direction by means of a spring 18 and can be lifted from valve seat 21 by means of a servo control pressure which is effective in chamber 20 and works against the force of bias spring 18. The control pressure for chamber 20 is supplied by a servo-pressure regulator 23 via a channel 22 with the setpoint of the pressure regulator being adjustable by means of a solenoid operator 24.

In one of the rooms which are heated by the hot water heating system a room thermostat 25 is provided whose internal contact closes as soon as the room temperature sensed by its temperature sensor falls below the setpoint as adjusted at the room thermostat. Thereby a switching signal from the thermostat contacts is supplied to an electrical controller 26 which switches on the gas control apparatus 11 and by means of a solenoid operator 24 controls the gas flow to the burner 7. The construction and operation of a suitable gas control apparatus for gas control 11 are known from the European Pat. No. 62 856 and therefore are not described in detail herein. Briefly, in the control chamber 20 of the diaphragm actuator for the main valve 15, 21 a control pressure proportional to the demand of heat is built up, which pressure lifts closure member 15 from seat 21. Thereby, gas flows via pipe 52 to injector nozzle 53 which is located opposite a gas inlet 54 of burner 7. The gas stream simultaneously draws primary air and supplies this primary air to the burner 7. A pilot burner 28 is connected to the gas control apparatus by means of a pilot pipe 27. Its flame heats up a thermocouple 29 which keeps safety valve 14 open by means of power unit 30.

Since the primary air drawn by the ags stream through injector nozzle 15 is not sufficient for obtaining a complete combustion of the gas, a second injector nozzle 55 is provided and is located opposite a secondary air inlet 31 of the boiler 6. This second injector nozzle 55 is connected to the outlet 33 of an air control valve 34 via a pipe 32. A blower 35 feeds air under pressure to the gas control valve 34. The closure member 36 of this gas control valve is biased in a closing direction by means of a spring 37 and can be lifted from valve seat 40 by means of the control pressure in chamber 38 which acts upon diaphragm 39, as soon as the pressure in chamber 38 exceeds the forces which are exercised on diaphragm 39 by bias spring 37 and the gas pressure at outlet 33. The construction and operation of this air control valve 34 are also shown in FIG. 2 of the European Pat. No. 62 856.

The amount of air supplied to second injector nozzle 55 is controlled by a solenoid operator 41 which is mounted on a servopressure regulator. For this purpose an oxygen sensor or carbon dioxide sensor 43 is located in an exhaust stack 42, and the output signal of this sensor is supplied to a second electrical controller 44. If the amount of excessive oxygen or air in stack 42 falls below a predetermined setpoint, controller 44 delivers an output signal to solenoid operator 41 of the servopressure regulator 45 which is mounted on air control valve 34. By this output signal the setpoint of the pressure regulator is increased, and, therewith, the air control valve 36,40 is opened further. As a result, more secondary air flows to injector nozzle 55 and therewith into the internal space of the boiler 6 so that the excessive air measured by the sensor 43 increases also. On the other hand, if there is too much air supplied to the burner 7 as measured in the stack 42, the air control valve 34 will reduce the amount of secondary air. Instead of providing an air control valve 34 between blower 35 and secondary air nozzle 55 a blower may be used whose speed and thereby its supply of air can be controlled directly. In this case the output line 46 of controller 44 is directly connected to a blower control circuit (not shown) which controls the speed of blower 35. Such motor speed control circuits are known in the art, and therefore, do not need to be described further herein.

The room thermostat 25 normally is located in the most important room to be heated, e.g., in the living room. In addition, radiator thermostats 47*a* and 47*c* may be associated with radiators 1*a* and 1*c*, respectively, in order to maintain a desired temperature in the associated room. The room thermostat, in addition, can be provided with a block and with a means for night temperature setback. Room thermostats of this type, so-called clock thermostats, are also known in the art. The room thermostat usually delivers a switching signal which indicates that a supply of heat to the room is required. This signal can be delivered by a room thermostat and, also by another sensor. This signal does not indicate, however, the level of the demand for heat within the respective room is or even how large the demand of heat for the entire heating system is at this time, i.e., it only indicates that there is a demand for heat.

The required heating power which has to be delivered by the burner, however, depends on the instant level of the demand for heat. If only little heat is required, a full power operation of the burner 7 would lead to overheating of the heat transmission medium (normally water) and therewith would lead to an undesired temperature increase in the room and to a wasting of fuel. If on the other hand the burner 7 is operated with an insufficient heating power, the period of time required for reaching the desired room temperature is very long and sometimes cannot be accepted for comfort reasons as well as for economic reasons. In particular, in order to save energy it is important to adapt the heating power of the burner 7 to the instant demand of heat. This purpose is achieved by using the output signal of the heat consumption meter 8 which as is known from European Pat. No. 24 778 delivers an output signal which is proportional to the amount of heat which is instantly supplied to the heating system. This output signal may be integrated over a period of time and used as a measure for the heat consumption or energy consumption of the heating system.

According to the invention, this output signal simultaneously is used for adapting the heating power of the burner 7 to the instant demand of heat in the heating system. For this purpose the output signal is delivered to an integrator 48 which includes a timer. This integrator during a predetermined period of time measures the consumed amount of heat and stores a signal corresponding to this amount of heat. A comparator 49 is connected to the integrator 48, and this comparator 49 compares the above-mentioned signal and with the amount of heat with a second signal which corresponds to the amount of heat consumated during the preceding period of time. These time periods are of equal length. By this comparison a signal is generated which controls the heating capacity of the burner and for this purpose is fed via line 50 to controller 26.

Assuming that the measured amount of heat during the just finished period of time $T_1$ has the value A and in the preceding period of time $T_2$ of equal length the amount of heat was B, a comparison of these two signals A and B can lead to the following conditions:

1. If A is smaller than B, the demand of heat has decreased and as a consequence the heat generating power of the burner 7 can be reduced.
2. If A = B, then the present heat generating power of the burner corresponds to the actual demand of heat.
3. If A is larger than B, the demand of heat has increased and the heat generating power of the burner 7 should also be increased.

The output signal on output line 50 of the comparator 49 affects the control signal of controller 26 which control signal is fed via line 51 whereby the amount of gas supplied to burner 7 is controlled also. The amount of combustion air required for complete and optimum combustion is automatically adjusted as mentioned above by means of sensor 43 which measures the excess oxygen in stack 42 and delivers a signal to controller 44 and solenoid operator 41 for controlling the supply of secondary air into the injector nozzle 55. An essential advantage of the permanent adjustment and adaptation of the burner power to the instant or actual demand of heat in connection with the determination of the demand of heat by reference to the amount of heat as supplied to the heating system consists in the fact that all external values changing the demand of heat are automatically considered as well. Neither a separate outside temperature sensor nor a further sensor for speed of wind, humidity, sun radiation or other conditions influencing the demand of heat are required. Even influences which are caused by the operation of or by the utilization of the building being heated are automatically considered. Examples of such internal influences are the opening of windows, the switching "on" of heat generating apparatus and illumination, the generation of heat by people within the room or the change of the temperature setting at individual radiators by means of a radiator thermostat. All these influences are automatically included in the control of the burner power if the instant heat consumption is the measure for the burner power. This burner power is adjusted in such a way that the required amount of heat is available within a predetermined period of time in order to avoid undesired temperature fluctuations or hunting of the temperature. Only such an amount of heat is generated as is actually requried. This simultaneously means that the burner operates with lower power but over longer periods of time, whereby the exhaust gas temperature and the heat losses through the stack are decreased. The burner always operates with the optimum efficiency. Integrator 48 and comparator 49 may be formed by a microprocessor which simultaneously can be part of electric controllers 44 and 26. The two controllers 44 and 26 together with integrator 48 and comparator 49 preferably are combined into a single electronic control apparatus with a common power supply.

Accordingly, it may be seen that there has been provided, in accordance with the present invention, an improved hot water heating system.

The embodiments of the present invention in which an exclusive property or privilege is claimed are defined as follows:

1. A hot water heating system comprising a heat consumption meter for providing an electrical output signal proportional to the amount of heat being supplied to the heating system and a controller means which controls the heating power of a heat generator, said output signal being supplied as an input signal to said controller, wherein said controller means includes an integrator having a timer and being connected to receive the output of said heat consumption meter, said integrator measuring the amount of heat consumed during a predetermined period of time and storing a corresponding signal and a comparator connected to said integrator, with said comparator comparing the measured amount of currently supplied heat with an amount of heat measured during a preceding period of time of equal length and from this comparison deriving a control signal for controlling the heating power of the heat generator.

2. A system according to claim 1 wherein said integrator and said comparator are formed by a microprocessor.

3. A system according to claim 2 wherein said controller receives a further input of an output signal of a room thermostat.

4. A system according to claim 1 wherein said controller means includes a controller for controlling the amount of combustion air fed to the heat generator, an input of the controller being connected to an output signal from a gas sensor located in a stack and the output signal of the controller being fed to a control means controlling the amount of combustion air to the heat generator.

5. A system according to claim 3 wherein said controller is formed by a microprocessor.

* * * * *